US011351596B2

(12) United States Patent
Poland

(10) Patent No.: US 11,351,596 B2
(45) Date of Patent: Jun. 7, 2022

(54) DEVICE FOR CONTINUOUS BENDING OF METAL MESH

(71) Applicant: Slick Tools LLC, Boulder, CO (US)

(72) Inventor: Marshall Poland, Boulder, CO (US)

(73) Assignee: SLICK TOOLS LLC, Boulder, CO (US)

( * ) Notice: Subject to any disclaimer, the term of this patent is extended or adjusted under 35 U.S.C. 154(b) by 58 days.

(21) Appl. No.: 17/020,871

(22) Filed: Sep. 15, 2020

(65) Prior Publication Data

US 2021/0229159 A1 Jul. 29, 2021

Related U.S. Application Data

(60) Provisional application No. 62/966,016, filed on Jan. 26, 2020.

(51) Int. Cl.
*B21F 31/00* (2006.01)

(52) U.S. Cl.
CPC ..... *B21F 31/00* (2013.01)

(58) Field of Classification Search
CPC . B21D 5/06; B21D 5/08; B21D 5/083; B21D 5/12; B21D 5/14; B21D 11/20; B21D 11/203; B21F 31/00; B21F 27/127; B21F 33/00; B21F 1/004; B21F 45/00; Y10T 29/18
USPC ..... 140/107
See application file for complete search history.

(56) References Cited

U.S. PATENT DOCUMENTS 1,203,090 A 10/1916 Yoder
1,909,930 A * 5/1933 De Ridder ..... B21D 5/06 72/166
2,292,810 A * 8/1942 Woeller ..... B21C 37/09 72/177
2,442,943 A * 6/1948 Wayne ..... B21D 5/08 72/178
2,783,668 A 3/1957 Max
2,831,521 A * 4/1958 Collins ..... B21D 5/08 29/505
2,911,030 A * 11/1959 Kocks ..... B21D 5/10 72/166
3,145,758 A 8/1964 Sprung et al.
3,602,024 A * 8/1971 Sabroff ..... B21C 23/007 72/60
3,610,191 A 10/1971 Harris, Jr.
(Continued)

FOREIGN PATENT DOCUMENTS

CA 2034359 3/1996
DE 102011117769 A1 * 5/2013 ..... B21D 5/08
ES 2265196 11/2007

*Primary Examiner* — Edward T Tolan

(57) ABSTRACT

A material-forming device for a wire mesh includes a plurality of contact rods that are supported by the frame and configured to threadedly receive a sheet of wire mesh that moves through the plurality of contact rods in a downstream direction. An inner contact rod and an outer contact rod are each configured to engage a first side of the sheet of wire mesh, and a middle contact rod is positioned between the inner contact rod and the outer rod and configured to engage a second side of the sheet of wire mesh that opposes the first side. The shape of the outer contact rod and/or the inner contact rod is configured to bend the sheet of wire mesh around the middle contact rod as the sheet of wire mesh moves in the downstream direction.

18 Claims, 8 Drawing Sheets

(56) References Cited

U.S. PATENT DOCUMENTS

| | | | | | |
|---|---|---|---|---|---|
| 3,814,144 | A * | 6/1974 | Spencer | B21F 33/00 | 140/107 |
| 3,931,725 | A | 1/1976 | Yon | | |
| 4,271,777 | A * | 6/1981 | Collins | B21D 51/2646 | 413/76 |
| 4,383,430 | A | 5/1983 | Klaus | | |
| 4,412,565 | A * | 11/1983 | Broberg, Jr. | B21F 1/02 | 140/123 |
| 4,770,018 | A * | 9/1988 | Bosl | E04C 2/08 | 72/177 |
| 5,237,846 | A * | 8/1993 | Brooks, Jr. | B21D 5/083 | 72/177 |
| 5,813,594 | A * | 9/1998 | Sturrus | B60R 19/03 | 228/146 |
| 6,481,259 | B1 * | 11/2002 | Durney | E02D 17/202 | 72/324 |
| 2009/0205387 | A1 * | 8/2009 | Durney | B21D 11/08 | 72/178 |

* cited by examiner

Fig. 4
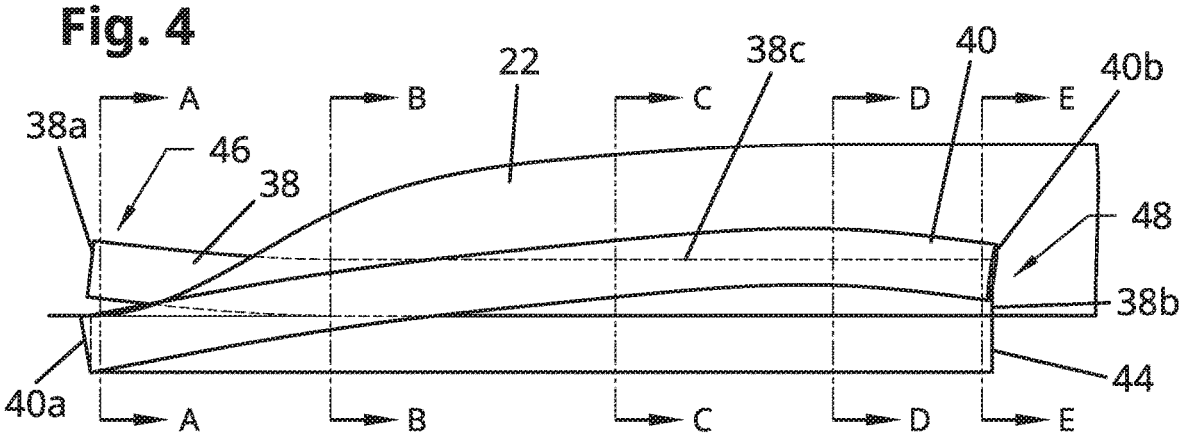
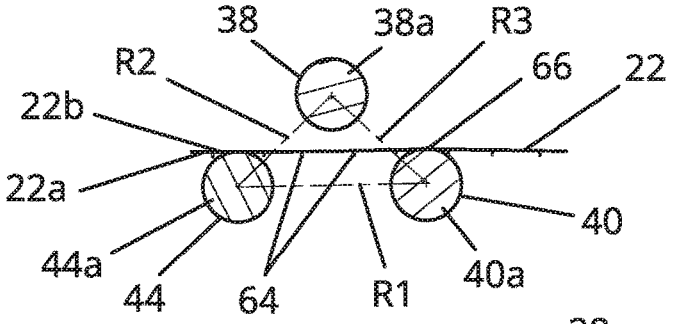
Fig. 5
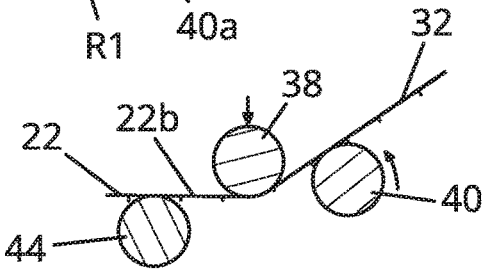
Fig. 6
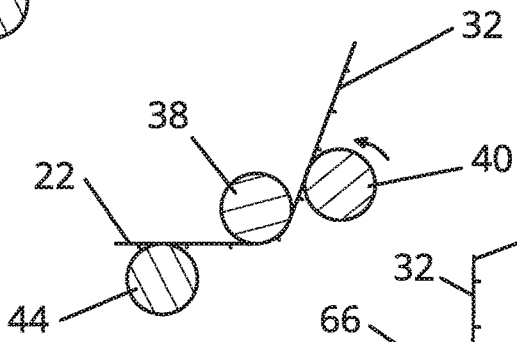
Fig. 7
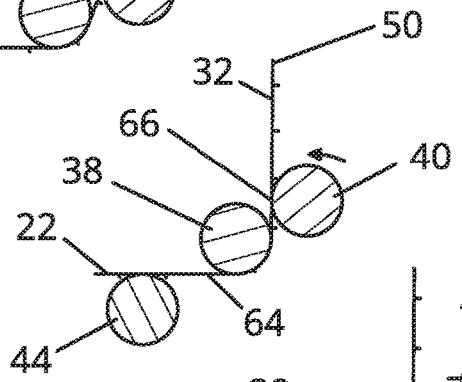
Fig. 8
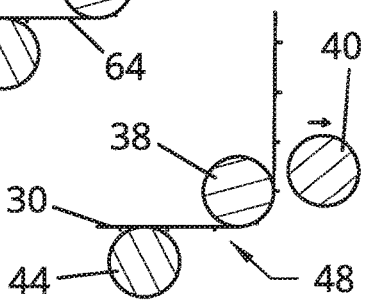
Fig. 9

DEVICE FOR CONTINUOUS BENDING OF METAL MESH

RELATED APPLICATIONS

This application claims priority of U.S. Provisional Application No. 62/966,016, filed on Jan. 26, 2020, which is incorporated herein by reference in its entirety.

FIELD OF INVENTION

The invention relates to solar panel installations, and more particularly, to a machine and method for bending a metal mesh to form an animal guard for a solar panel installation.

DESCRIPTION OF THE RELATED ART

Solar photovoltaic ("PV") panels are being installed at an increasing rate around the world due to their ability to generate clean, low-cost energy. As the number and age of installed PV systems grows, their vulnerabilities have become more apparent. One cause of performance degradation and system downtime is the intrusion of animal and plant life into the PV system. Rodents and birds tend to build nests underneath solar panels and chew on exposed system components, such as wire insulation. This degrades and disrupts PV system performance, necessitating expensive repairs; and creates fire and electrocution hazards. It has therefore become an industry best practice to include a wire mesh animal guard in solar PV installations, which prevents the incursion of pests into the area behind the solar array. The mesh is commonly applied to seal a 7.6 to 15.2 centimeter (3.0 to 6.0 inch) gap which exists around the perimeter of "flush mount" solar arrays, which are mounted parallel to and offset from a building rooftop or other exterior surface.

The wire mesh is commonly supplied in strip form, where a long piece (e.g. 30.5 meters long by 20.3 centimeters or 100 feet long by 8 inches wide) is coiled into a roll for easy storage and transport. When uncoiled, the mesh has no structural rigidity, similar to an unfolded sheet of paper. In this form, it must be attached to the solar PV system at many points in order to resist the forces of nature over the life expectancy of the solar system, which may be 20 to 30 years. Making these attachments is difficult and time consuming for several reasons. For example, most solar panel warranties are voided if the panel's frame is penetrated, such as by a fastener. Additionally, in a flush mount PV system, it is rarely an option to attach the wire mesh to the roof itself, as this could penetrate the waterproofing layers and cause leaks. To reduce the number of required attachments, some solar installers strengthen the wire mesh by placing one or more longitudinal bends into it prior to installation. Just as a piece of paper creased along its length gains rigidity, a wire mesh strip which has been bent into a profile gains a moment of inertia that resists further bending.

Prior attempts to bend the wire mesh strip into a profile include manually bending the wire mesh strip by hand. This method is disadvantageous in that it is a slow and painful process that wastes time and causes repetitive stress injuries. Some existing metal bending techniques involve large amounts of surface contact and sliding friction between the machine and material, making them unsuitable for hand-powered operation. Some existing techniques may necessitate the use of a motor and external power source, which diminishes portability. Still other disadvantages of existing techniques are that they incorporate numerous moving parts, making them complex, prone to failure, and expensive to manufacture and maintain.

SUMMARY OF THE INVENTION

The present application provides a material-forming machine or device and method for bending a flat sheet of material, such as a metal mesh. The material-forming device uses an arrangement of contact rods that are configured to continuously contact the sheet of material during bending of the sheet of material to form a sheet of material having a desired bend profile. For example, an outer edge of the wire mesh may be bent, angled, or curved relative to a planar portion of the wire mesh, such that the formed wire mesh has a profile suitable for integration as an animal guard in a solar panel installation.

In a general embodiment, a material-forming device includes a plurality of contact rods that are supported by the frame and configured to threadedly receive a sheet of wire mesh that moves through the plurality of contact rods in a downstream direction. The contact rods may be cylindrical in shape. In other exemplary embodiments, the contact rods may have any other suitable shape, such as rectangular. An inner contact rod and an outer contact rod are each configured to engage a first side of the sheet of wire mesh, and a middle contact rod is positioned between the inner contact rod and the outer rod and configured to engage a second side of the sheet of wire mesh that opposes the first side.

The contact rods may have linear or non-linear axes and same or similar shapes. The inner contact rod and the middle contact rod may have a linear axis and the outer contact rod may have a non-linear axis and a serpentine shape. In other exemplary embodiments, both the inner contact rod and the outer contact rod may have a non-linear axis and serpentine shape, with the middle rod being linear. In other exemplary embodiments, the contact rod arrangement may have two radially spaced middle contact rods that engages the second side of the wire mesh between the inner contact rod and the outer contact rod. In still other exemplary embodiments, all of the rods may have linear axes that are arranged non-parallel relative to each other. Many other configurations of the contact rods may be possible to provide a bend profile or multiple bend profiles of the sheet of wire mesh.

The rods may be non-rotatably supported by the frame during downstream movement of the wire mesh. In other exemplary embodiments, at least one of the contact rods may be rotatable relative to at least one of the other rods. In any embodiment, the shape of the contact rods is configured to bend the sheet of wire mesh around at least one of the contact rods as the sheet of wire mesh moves in the downstream direction.

The arrangement of the contact rods is advantageous in enabling continuous contact with the sheet of wire mesh during bending while also maintaining an alignment of the sheet of wire mesh. At least one of the inner contact rod and the outer contact rod may be formed such that a trajectory of a point of contact of the rod with the sheet of wire mesh defines an involute curve about the middle contact rod if projected onto a plane that is perpendicular to the downstream direction and the longitudinal axis of the device.

The contact rods are radially spaced to facilitate the threaded insertion of the wire mesh between the contact rods. The positioning of the contact rods also enables the contact rods to contact the wire mesh at locations between the longitudinal wires of the wire mesh to prevent shifting or misalignment of the wire mesh as the wire mesh is moved through the material-forming device. In an effort to reduce frictional forces acting on the sheet of wire mesh, the frame is configured to support the contact rods such that the sheet of wire mesh only contacts the contact rods during the forming process, without contacting the frame.

Advantageously, the configuration of the contact rods enables bending the sheet of wire mess without requiring electrical power or a more complex arrangement of moving components. The material-forming device may be formed of light-weight materials that enable portability of the device. The portable device may be manually operable. In exemplary embodiments, the material-forming device may be mounted to any suitable supporting surface, such as a ground surface, vehicle surface, or workbench during operation. In other exemplary embodiments, the material-forming device may be handheld, such that a user may hold the device in one hand and pull the wire mesh through the contact rods with the other hand. In still other exemplary embodiments, feeding and removing the wire mesh may be automated.

The bend profile of an edge of the formed sheet of wire mesh may be approximately 90 degrees, or an angle that is between 45 and 180 degrees relative to a planar portion of the wire mesh. Other bend angles may be suitable and the bend angle may be dependent on the application. The bend angle and final bend profile may be adjustable by adjusting the arrangement of the contact rods. For example, a downstream axial end of the outer contact rod may be displaced using an adjustment arm mounted to the frame.

In still other exemplary embodiments, two or more sets of contact rods may be provided. The contact rods may be arranged to simultaneously bend opposite edges of the sheet of wire mesh, or sequentially bend opposite edges or a same edge of the wire mesh. The sets of contact rods may be mirrored along a longitudinal axis of the material-forming device to form a symmetrical formed sheet of wire mesh, or the contact rods in each set of contact rods may be arranged differently if different bend profiles are desired. Accordingly, the material-forming device may be modular in that any number of sets of contact rods may be configured to simultaneously and/or sequentially form different bend profiles for a sheet of material.

In still other exemplary embodiments, a distance between two sets of contact rods may be adjusted to accommodate for different sizes of the sheet of material. Any suitable adjustment mechanism may be used to fix a position of the set of contact rods after adjustment, such as a clamp or knob.

According to an aspect of the invention, a material-forming device for a wire mesh includes a contact rod arrangement that threadedly receives and bends the wire mesh as the wire mesh is pulled through the material-forming device.

According to an aspect of the invention, a material-forming device includes a frame defining a longitudinal axis, and a plurality of contact rods that are supported by the frame and elongated along the longitudinal axis, the plurality of contact rods being configured to threadedly receive a sheet of the wire mesh that moves through the plurality of contact rods in a downstream direction that is parallel to the longitudinal axis, the plurality of contact rods including an inner contact rod and an outer contact rod that are each configured to engage a first side of the sheet of wire mesh, and a middle contact rod positioned between the inner contact rod and the outer rod and configured to engage a second side of the sheet of wire mesh that opposes the first side, with at least one of the outer contact rod and the inner contact rod being configured to bend the sheet of wire mesh about the middle contact rod as the sheet of wire mesh moves in the downstream direction.

According to an embodiment of any paragraph(s) of this summary, at least one of the outer contact rod and the inner contact rod is serpentine in shape.

According to an embodiment of any paragraph(s) of this summary, a trajectory of a point of contact between at least one of the outer contact rod and the sheet of wire mesh or the inner contact rod and the sheet of wire mesh defines an involute curve about the middle contact rod when projected onto a plane that is perpendicular to the longitudinal axis.

According to an embodiment of any paragraph(s) of this summary, the plurality of contact rods are configured to continuously contact the sheet of wire mesh during movement of the sheet of wire mesh.

According to an embodiment of any paragraph(s) of this summary, the plurality of contact rods are radially spaced, and wherein a radial spacing between the outer contact rod and the middle contact rod changes along the longitudinal axis.

According to an embodiment of any paragraph(s) of this summary, the plurality of contact rods are positioned to maintain a total curve length of the sheet of wire mesh that is constant as the sheet of wire mesh moves in the downstream direction along an entire longitudinal length of the material-forming device, the total curve length being defined by a first curve length between an inner contact point between the inner contact rod and the first side of the sheet of wire mesh and a middle contact point between the middle contact rod and the second side of the sheet of wire mesh, added to a second curve length between the middle contact point and an outer contact point between the outer contact rod and the first side of the sheet of wire mesh.

According to an embodiment of any paragraph(s) of this summary, the plurality of contact rods are positioned to always contact the sheet of wire mesh at contact points formed between longitudinal wires of the sheet of wire mesh.

According to an embodiment of any paragraph(s) of this summary, the outer contact rod is formed of a flexible material.

According to an embodiment of any paragraph(s) of this summary, the frame includes an adjustment arm engageable with a downstream axial end of the outer contact rod to displace the axial end of the outer contact rod, thereby adjusting a bend profile of the sheet of wire mesh material.

According to an embodiment of any paragraph(s) of this summary, a downstream axial end of the outer contact rod is retractable in a radial direction away from the middle contact rod.

According to an embodiment of any paragraph(s) of this summary, the middle contact rod has a linear axis that is parallel with the longitudinal.

According to an embodiment of any paragraph(s) of this summary, each of the inner contact rod and the outer contact rod have a non-linear axis.

According to an embodiment of any paragraph(s) of this summary, the inner contact rod has a linear axis that is parallel with the longitudinal axis and the outer contact rod has a non-linear axis.

According to an embodiment of any paragraph(s) of this summary, the material-forming device includes a second inner rod that is positioned between the inner contact rod and the outer contact rod, the second inner rod being radially spaced from the inner rod and configured to engage the second side of the sheet of wire mesh.

According to an embodiment of any paragraph(s) of this summary, the plurality of contact rods includes two or more sets of contact rods, each of the sets of contact rods having the inner contact rod, the outer contact rod, and the middle contact rod, the two or more sets of contact rods being configured to simultaneously or sequentially engage the sheet of wire mesh.

According to an embodiment of any paragraph(s) of this summary, the frame includes separable frame portions that each support one of the sets of contact rods and are movable toward and away from each other to adjust a distance between the sets of contact rods.

According to an embodiment of any paragraph(s) of this summary, the material-forming device includes a track over which the separable frames are slidable, and at least one adjustable clamp that secures at least one of the separable frame portions in a fixed position relative to the track.

According to an embodiment of any paragraph(s) of this summary, the frame includes at least one plate that supports the plurality of contact rods.

According to an embodiment of any paragraph(s) of this summary, the at least one plate defines a material-receiving through-slot through which the sheet of wire mesh passes without contacting the at least one plate.

According to an embodiment of any paragraph(s) of this summary, the at least one plate includes a plurality of plates that are parallel and axially spaced, each of the plurality of plates having a cutout that intersects the material-receiving through-slot and supports the plurality of contact rods.

According to an embodiment of any paragraph(s) of this summary, a shape of the material-receiving through-slot is varied in each of the plurality of plates to correspond to a changing shape of the sheet of wire mesh as the sheet of wire mesh is bent in the downstream direction.

According to another aspect of the invention, a method of bending a sheet of wire mesh includes threadedly inserting the sheet of wire mesh into a contact rod arrangement supported by a frame defining a longitudinal axis, engaging a first side of the sheet of wire mesh with an inner contact rod and an outer contact rod that is radially spaced from the inner contact rod, engaging a second side of the sheet of wire mesh that opposes the first side with a middle contact rod that is radially spaced from and positioned between the inner contact rod and the outer contact rod, moving the sheet of wire mesh through the contact rod arrangement in a downstream direction that is parallel to the longitudinal axis, and bending the sheet of wire mesh about the middle contact rod via at least one of the inner contact rod and the outer contact rod engaging the sheet of wire mesh as the sheet of wire mesh is moved in the downstream direction.

According to an embodiment of any paragraph(s) of this summary, the method further includes at least one of adjusting a bend angle of the sheet of wire mesh by bending an axial end of the outer contact rod, and adjusting a width of the contact rod engagement.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

FIG. 4 shows a side view of the contact rod arrangement of FIG. 2 in which a sheet of wire mesh is threadedly inserted into the contact rod arrangement.

FIG. 5 shows a front sectional view of the contact rod arrangement of FIG. 4 taken along line A-A.

FIG. 6 shows a farther downstream front sectional view of the contact rod arrangement of FIG. 4 taken along line B-B in which the sheet of wire mesh is initially bent by an outer contact rod that engages the sheet of wire mesh to wrap the sheet of wire mesh around a middle contact rod.

FIG. 7 shows still a farther downstream front sectional view of the contact rod arrangement of FIG. 4 taken along line C-C in which the sheet of wire mesh is further bent around the middle contact rod.

FIG. 8 shows still a farther downstream front sectional view of the contact rod arrangement of FIG. 4 taken along line D-D in which the sheet of wire mesh is bent into a final profile.

FIG. 9 shows still a farther downstream front sectional view of the contact rod arrangement of FIG. 4 taken along line E-E in which the outer contact rod retracts away from the middle contact rod.

DETAILED DESCRIPTION

The device and principles described herein have particular application in solar panel installations that require bending a wire mesh material to form an animal guard. Other applications that require an animal guard may be suitable, such as in farming or gardening. Any application that requires forming a wire mesh material having longitudinal wires may also be suitable. For example, different industries that use wire mesh material for fences, cages, or concrete reinforcement may be suitable. Any sheet of material that includes longitudinal features may be suitable. Applications using a strip-sheet metal, polymer-based material, or corrugated sheets of material that require material forming may also be suitable. Many other applications may be suitable.

Figure 1:
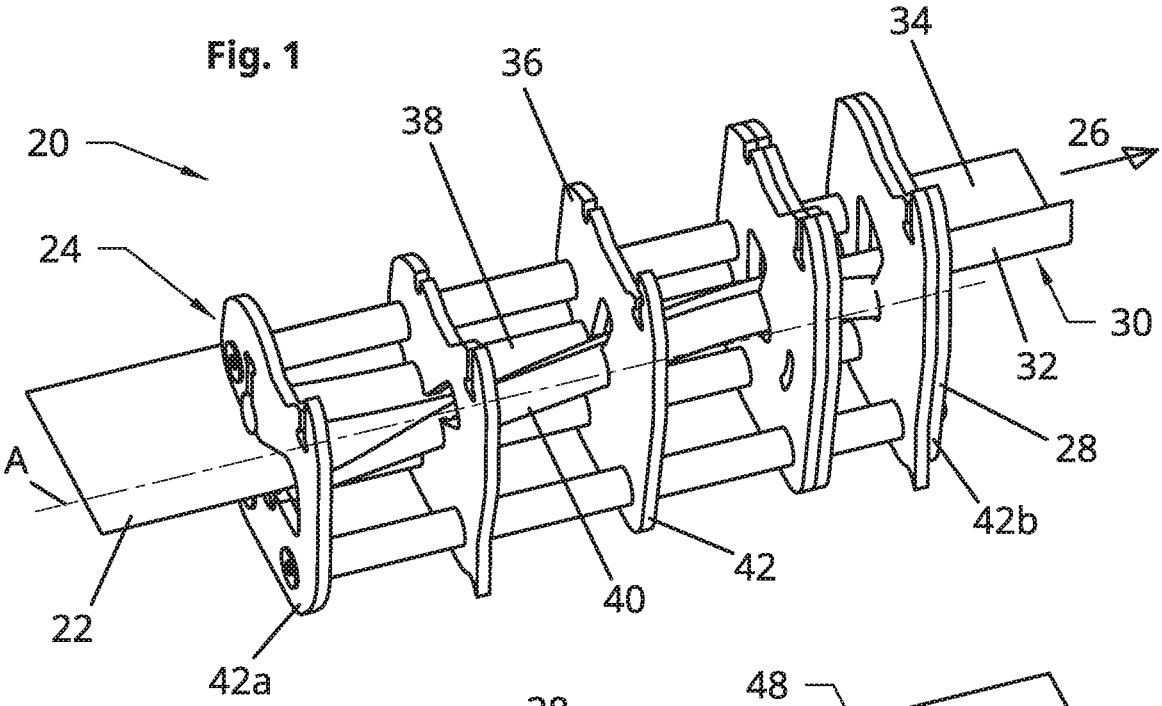
FIG. 1 shows a material-forming device according to an embodiment of the present application.

Referring first to FIG. 1, a material-forming machine or device 20 according to an exemplary embodiment of the present application is shown. The material-forming device 20 is configured to receive a sheet of material 22 at an upstream or entry end 24 of the material-forming device 20. The sheet of material 22 may be a planar or flat strip of any suitable raw material, such as a metal mesh, a sheet metal flashing, or a polymer-based material. Other materials may be suitable. It should be recognized that although the sheet of material 22 may be generally described as a continuous sheet of material, the sheet of material 22 may be in the form of a wire mesh that is a lattice of wires, rather than a continuous sheet.

In exemplary embodiments, the sheet of material 22 may be part of a roll of material that is unrolled to provide a flat sheet of material to feed to the material-forming device 20. The sheet of material 22 may be manually fed into the material-forming device 20 by a user. Movement of the sheet of material 22 through the material-forming device 20 may occur by manual pushing and/or pulling. In other exemplary embodiments, the sheet of material 22 may be automatically fed into the material-forming device 20.

The sheet of material 22 is moved through the material-forming device 20 in a downstream direction 26 toward the exit end 28 at which the formed sheet of material 30 is removed from the material-forming device 20. The material-forming device 20 is configured to deform the sheet of material 22 to form the formed sheet of material 30 having a bend portion 32. The bend portion 32 of the formed sheet of material 30 may be formed as an outer edge of the sheet of material 22 that is bent at an angle relative to a planar portion 34 of the sheet of material 22. In other exemplary embodiments, the bend portion 32 may be formed in a middle portion of the sheet of material 22 or a portion that is spaced away from an outer edge. The bend portion 32 may be angled relative to the planar portion 34 by an angle that is between 45 and 180 degrees. In exemplary applications, the angle may be approximately 90 degrees. Other angles may be suitable and the angle is dependent on the desired shape or profile of the formed sheet of material 30 as required for a particular application.

The sheet of material 22 may be inserted into the material-forming device 20 in an orientation in which the sheet of material 22 is horizontal or extends in a plane that is parallel with a bottom of the material-forming device 20 or a supporting surface on which the material-forming device 20 is arranged. The bend portion 32 may be formed to extend upwardly relative to the plane of the sheet of material 22 when the formed sheet of material 30 exits the material-forming device 20. When a desired length of the formed sheet of material 30 is removed from the material-forming device 20, the formed sheet of material 30 may be cut using any suitable cutting tool. In an exemplary embodiment, shears, a knife, saw, wire cutter, or other cutting tool may be integrated into the material-forming device 20 at the entry end 24 or the exit end 28.

The material-forming device 20 includes a frame 36 that supports a plurality of contact rods 38, 40 and defines a longitudinal axis A for the material-forming device 20. The longitudinal axis A is a central axis of the material-forming device and is parallel to the downstream direction 26. The plurality of contact rods 38, 40 are configured to threadedly receive the sheet of material 22 which moves through the contact rods 38, 40 in the downstream direction 26. The frame 36 is configured to prevent distortion of the contact rods 38, 40 as the sheet of material 22 is moved through the material-forming device 20. The contact rods 38, 40 are elongated along the longitudinal axis A. In exemplary embodiments, the contact rods 38, 40 may be non-rotatably and fixedly supported. In other exemplary embodiments, at least one of the contact rods 38, 40 may be rotatable relative to the other contact rods 38, 40.

In an exemplary embodiment, the frame 36 is formed of at least one plate 42. The frame 36 may include a plurality of plates 42 that are axially spaced along the longitudinal axis A of the frame 36. Each of the plates 42 is planar in shape and extends in a direction that is perpendicular to the longitudinal axis A of the frame 36. The plates 42 are configured to support the material-forming device 20 on any suitable support surface, such as a ground surface, a vehicle surface, or a workbench. Any suitable securing device may be used to securely mount the frame 36 to the support surface. For example, clamps, fasteners, cables, anchors, etc. may be arranged between the plates 42 and the support surface.

The plates 42 are configured to support the contact rods 38, 40 which maintain continuous contact with the sheet of material 22 during the forming process. Each of the contact rods 38, 40 is supported by each of the plates 42 such that the contact rods 38, 40 may extend an entire longitudinal length of the frame 36. Advantageously, the plates 42 do not have contact with the sheet of material 22, such that sliding friction forces between the frame 36 and the sheet of material 22 are eliminated. Any suitable shape may be used for the plates 42, such as rectangular, and any number of plates 42 may be provided. Between two and eight plates may be suitable. Fewer than two or more than eight plates may be suitable in other embodiments. The plates 42 may be formed of any suitable lightweight and rigid material. Wood or plastic are examples of suitable materials. In an exemplary embodiment, each plate 42 may have a thickness that is between 0.3 and 5.1 centimeters (between 0.1 and 2.0 inches).

The plates 42 proximate the entry end 24 of the material-forming device 20 may have a same or similar size and/or thickness. The size and/or thickness of the plates 42 may increase toward the downstream exit end 28 of the material-forming device 20. For example, a single plate 42*a* may define the entry end 24 and two plates 42*b* may be adhered together to form a single structure that defines the exit end 28 and has a thickness that is twice the thickness of the single plate 42*a*. The axial spacing between the plates 42 may decrease in the downstream direction 26. Advantageously, the thicker plates 42 and decreased spacing between the plates 42 enables stronger support for the frame 36 at the downstream end when the formed sheet of material 30 is removed from the material-forming device 20 since a maximum pressure on the contact rods 38, 40 may occur where the maximum bend of the sheet of material 22 is achieved.

Figure 2:
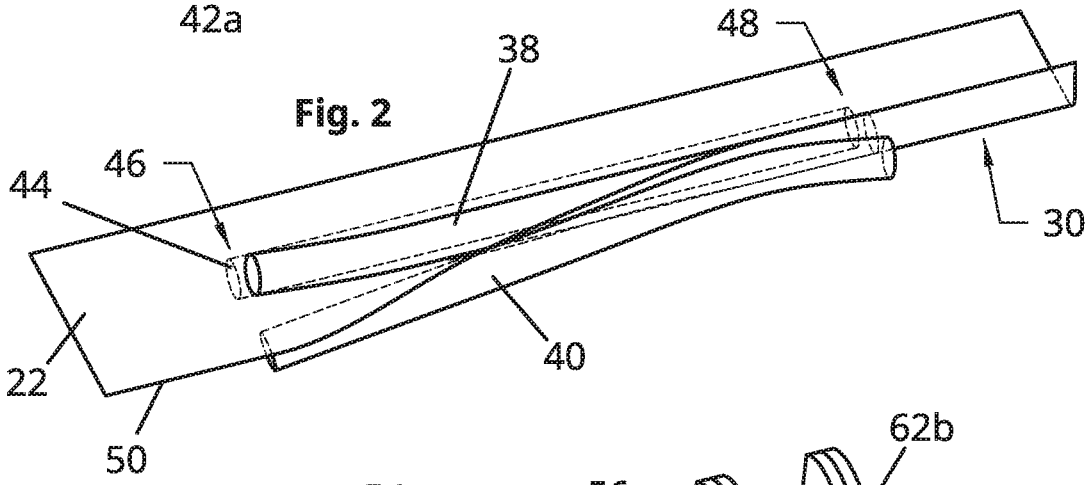
FIG. 2 shows a contact rod arrangement of the material-forming device of FIG. 1.

FIG. 2 shows an exemplary arrangement of the contact rods 38, 40, 44 that threadedly receive the sheet of material 22 and form the sheet of material 22 into the formed sheet of material 30. The contact rods 38, 40, 44 include a middle contact rod 38, an outer contact rod 40, and an inner contact rod 44 that may remain stationary or in a fixed position during movement of the sheet of material 22 such that the sheet of material 22 is plastically deformed. In other exemplary embodiments, one of the contact rods 38, 40, 44 may be rotatable. If the material-forming device 20 (shown in FIG. 1) is supported on a supporting surface, the contact rods 38, 40, 44 remain stationary relative to the support surface. If the material-forming device 20 is handheld, the contact rods 38, 40, 44 remain stationary relative to a frame that supports the contact rods 38, 40, 44 and is held by the user. The sheet of material 22 moves through the contact rods 38, 40, 44 from an upstream end 46 toward a downstream end 48 of the contact rods 38, 40, 44.

Any suitable hard and low-friction material may be used to form the contact rods 38, 40, 44. The hardness of the material of the contact rods 38, 40, 44 is similar to or harder than the sheet of material 22. For example, if the sheet of material 22 is formed of steel, such as in a wire mesh, the contact rods 38, 40, 44 may be formed of a similar steel material or a hard plastic material. A thermoplastic material may be suitable. For example, polyethylene, such as ultra-high-molecular-weight polyethylene (UHMWE-PE), polytetrafluoroethylene (PTFE), or an acetal homopolymer, such as Delrin®, may be suitable. Other polished hard metal materials may also be suitable.

In an exemplary embodiment, the contacts rods 38, 40, 44 may be formed from a rigid metal material that has enough stiffness to hold its shape without requiring the frame 36 having the plurality of plates 42. In such an embodiment, the contact rods 38, 40, 44 may be coated or sleeved with a low-friction plastic material to facilitate movement of the sheet of material 22. At least one external frame plate may be provided to hold the contact rods 38, 40 in position relative to each other. For example, if the material-forming device 20 is handheld, the user may hold on to the external frame plate, such as a single axial plate 42, with one hand and the contact rods 38, 40, 44 may extend from the external frame plate. The user may pull the sheet of material 22 through the contact rods 38, 40 with the other hand.

In any embodiment, the contact rods 38, 40, 44 may be the only parts of the material-forming device 20 that directly contact the sheet of material 22. Three or more contact rods 38, 40, 44 may be provided and each of the contact rods 38, 40, 44 extend generally parallel to the longitudinal axis A of the frame 36 in the downstream direction 26. The outer contact rod 40 is an outermost contact rod meaning that the outer contact rod 40 is the closest contact rod to the outer edge 50 of the sheet of material 22 to be bent into the bent profile. The inner contact rod 44 is an innermost contact rod meaning that the inner contact rod 44 is the farthest contact rod from the outer edge 50 of the sheet of material 22. The middle contact rod 38 is positioned radially outwardly relative to the inner contact rod 44 and radially inwardly relative to the outer contact rod 40.

The inner contact rod 44 has a straight or linear axis that is parallel relative to the longitudinal axis A of the frame 36. The outer contact rod 40 is serpentine in shape such that the outer contact rod 40 has a non-linear axis relative to the longitudinal axis A of the frame 36 and the linear axis of the inner contact rod 44. The shape of the outer contact rod 40 is formed to provide a trajectory of the contact point between the outer contact rod 40 and the sheet of material 22 that is curved thereby bending the sheet of material 22 as the sheet of material 22 is moved along the outer contact rod 40. As also described further below, more specifically, the trajectory of the point of contact forms an involute curve about the middle contact rod 38 when projected in a plane that is perpendicular to the downstream direction 26 and the longitudinal axis A of the frame 36.

The distance from the outer edge 50 of the sheet of material 22 to the contact point with the outer contact rod 40 remains constant as the sheet of material 22 is wrapped around the middle contact rod 38, which is radially interposed between the inner contact rod 44 and the outer contact rod 40. All of the contact rods 38, 40, 44 are radially spaced by a distance relative to each other to enable threadedly inserting the sheet of material 22 and passage of the sheet of material 22 through the contact rods 38, 40, 44. For example, the axes of the contact rods 38, 40, 44 may be spaced by several centimeters or less. The radial distance between the axes changes in the downstream direction due to the non-linear shape of the outer contact rod 40. The middle contact rod 38 has an axis that is slightly curved at an upstream end 46 of the contact rods 38, 40, 44 and gradually becomes linear toward a downstream end 48 of the contact rods 38, 40, 44. At the downstream end 48, the axis of the middle contact rod 38 is parallel to the axis of the inner contact rod 44 and the longitudinal axis A of the frame 36.

Each of the contact rods 38, 40, 44 may have a similar axial length and outer diameter. In other exemplary embodiments, the middle contact rod 38 may be formed to have a larger diameter as compared with the inner contact rod 44 and the outer contact rod 40. The contact rods 38, 40, 44 may be hollow or solid cylindrical structures. In other exemplary embodiments, the contact rods 38, 40, 44 may be formed to have other shapes, such as rectangular. For example, the middle contact rod 38 may be rectangular and the inner contact rod 44 and the outer contact rod 40 may have a serpentine cylindrical shape. The outer diameter of each contact rod 38, 40, 44 may be constant along the entire length of the corresponding contact rod 38, 40, 44. In an exemplary embodiment, the outer diameter of each of the contact rods 38, 40, 44 may be between 0.8 and 4.0 centimeters (between 0.3 and 1.6 inches). The contact rods 38, 40, 44 may be sized up or down as required for a particular application. For example, the contact rods 38, 40, 44 may be sized based on the size of a wire mesh and the spacing between longitudinal wires of the wire mesh.

As shown in FIG. 2, the inner contact rod 44 and the outer contact rod 40 contact a first side of the sheet of material 22, such as a bottom side, and the middle contact rod 38 contacts a second opposite side of the sheet of material 22, such as a top side. In other exemplary embodiments, the inner contact rod 44 and the outer contact rod 40 may contact the top side of the sheet of material 22 and the middle contact rod 38 may contact the bottom side of the sheet of material 22. Other configurations of the contact rods 38, 40, 44 may be suitable and the configuration may be dependent on the number of contact rods 38, 40, 44 and the desired bend angle of the sheet of material 22.

Figure 3:
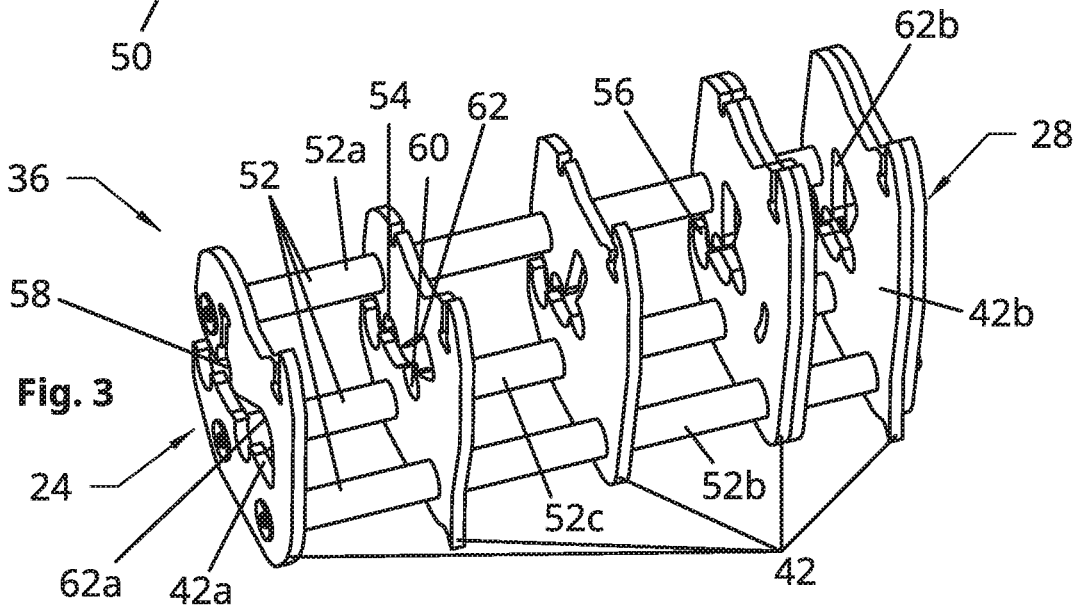
FIG. 3 shows a frame of the material-forming device of FIG. 1 that is configured to support the contact rod arrangement of FIG. 2.

FIG. 3 shows the frame 36 without the contact rods 38, 40, 44 in place. The plates 42 are supported by a plurality of rigid tubes 52 that are connected between the plates 42. The rigid tubes 52 may be formed of steel or any other suitable rigid material. Any number of rigid tubes 52 may be provided, such as between two and five. In an exemplary embodiment, one of the rigid tubes 52*a* may be arranged above the contact rods 38, 40, 44 and extends along one side of the frame 36. Another rigid tube 52*b* may be arranged below the contact rods 38, 40 and extends along an opposite side of the frame 36. Still another rigid tube 52*c* may be spaced from the rigid tubes 52*a*, 52*b* and is arranged below the contact rods 38, 40. The rigid tubes 52 are parallel to each other and the longitudinal axis A of the frame 36. In an exemplary embodiment, a diameter of the rigid tubes 52 may be similar to the diameter of the contact rods 38, 40, 44, such as between 0.8 and 4.0 centimeters (between 0.3 and 1.6 inches). The rigid tubes 52 may enable a user to carry the entire material-forming device 20 which is advantageously portable. In other exemplary embodiments, the frame 36 may be formed without the rigid tubes 52.

Each of the plates 42 has a cutout 54 on which the contact rods 38, 40, 44 are supported and through which the contact rods 38, 40, 44 extend. The cutouts 54 may be complementary in shape to the shape of the arrangement of the contact rods 38, 40, 44. A first portion 56 of the cutout 54 is formed to support the inner contact rod 44 on a side of the plates 42 and is open in a radial direction outside the plate 42. A second portion 58 of the cutout 54 is complementary with the middle contact rod 38 and a third portion 60 is complementary with the outer contact rod 40. The portions 56, 58, 60 of the cutout 54 are all in communication with each other. Given the changing shape of the arrangement of the contact rods 38, 40, 44 in the downstream direction, i.e. the changing radial distance between the outer contact rod 40 and the other contact rods 38, 44, the cutouts 54 are also varied in shape in the plates 42 to correspond to the changing shape of the contact rods 38, 40, 44.

Each of the plates 42 also has a material-receiving through-slot 62 through which the sheet of material 22 passes without contacting the plates 42. The material-receiving through-slot 62 intersects the corresponding cutout 54 such that the cutout 54 and the material-receiving through-slot 62 are continuous. For example, each portion 56, 68, 60 of the cutout 54 may extend upwardly or downwardly from the material-receiving through-slot 62. The shape of the material-receiving through-slot 62 is varied in each of the plates 42 to correspond to the changing shape of the edge of the sheet of material 22 as the sheet of material 22 moves in the downstream direction through the plates 42. For example, the material-receiving through-slot 62*a* in the axial plate 42*a* that defines the entry end 24 extends radially outwardly from the longitudinal axis A of the frame 36 in a direction that is configured to be parallel with the initially flat sheet of material 22.

The material-receiving through-slot 62 in each downstream plate 42 gradually curves in the radial direction. Each material-receiving through-slot 62 may be complementary in shape to the shape of the sheet of material 22 at the corresponding axial location along the material-forming device 20. The most downstream axial plate 42*b* that defines the exit end 28 for the formed sheet of material 30 may have a material-receiving through-slot 62*b* that extends perpendicular or upwardly relative to the material-receiving through-slot 62 in the axial plate 42*a*. The shape of the material-receiving through-slot 62*b* corresponds to the bend portion 32 of the formed sheet of material 30 (shown in FIG. 1). Many other shapes of the cutouts 54 and the material-receiving through-slots 62 may be suitable. The shapes may be dependent on the desired profile of the formed sheet of material 30.

Referring now to FIGS. 4-9, operation of the material-forming device 20 and forming of the sheet of material 22 is shown. A user may manually feed and/or push the sheet of material 22 into the material-forming device 20 (shown in FIG. 1) and/or pull the formed material out of the material-forming device 20. FIG. 4 shows a side view of the contact rods 38, 40, 44. As previously described, the inner contact rod 44 has the linear axis such that the inner contact rod 44 is straight from the upstream end 46 of the contact rods 38, 40, 44 to the downstream end 48. In the arrangement of the contact rods 38, 40, 44, the inner contact rod 44 may be a lowermost contact rod in the frame 36 (shown in FIG. 1). At the upstream end 46, an axial end 40*a* of the outer contact rod 40 is positioned adjacent the inner contact rod 44 and an axial end 38*a* of the middle contact rod 38 is positioned above the inner contact rod 44.

The axis of the outer contact rod 40 is non-linear such that the outer contact rod 40 extends upwardly relative to the inner contact rod 44. The axis of the middle contact rod 38 may also be non-linear such that the middle contact rod 38 is convexly curved with the axis of the middle contact rod 38 being concave up near the upstream end of the device 46 to facilitate threaded insertion of the wire mesh 22. At the downstream end 48, an axial end 38*b* of the middle contact rod 38 is parallel to the inner contact rod 44. Most of the main body 38*c* of the middle contact rod 38 between the axial ends 38*a*, 38*b* of the middle contact rod 38 may be parallel to the inner contact rod 44. The axis of the outer contact rod 40 near its axial end 40*b* at the downstream end 48 may be curved concave out and/or concave down, and is arranged above the axial end 38*b* of the middle contact rod 38 and the inner contact rod 44. As previously described, in addition to the upward and downward curves of the outer contact rod 40 shown in the side view of FIG. 4, the outer contact rod 40 also has curvature in the radial direction. Advantageously, the direction of curvature at the axial end 40*b* of the outer contact rod 40 may be away from and perpendicular to the sheet of material 22 to enable the bend of the curvature to slightly spring back before the sheet of material 22 exits the material-forming device 20.

FIG. 5 shows a front sectional view of the contact rods 38, 40, 44 and the sheet of material 22 as cut along line A-A shown in FIG. 4. The sheet of material 22, such as a wire mesh, is initially flat. The inner contact rod 44 and the outer contact rod 40 engage a first side or bottom side 22*a* of the sheet of material 22 when the sheet of material 22 is initially inserted into the contact rods 38, 40, 44. The radial spacing R1 between the axis of the axial end 44*a* of the inner contact rod 44 and the axis of the axial end 40*a* of the outer contact rod 40 may be greater than the radial spacing R2 between the axis of the axial end 38*a* of the middle contact rod 38 and the axis of the axial end 44*a* of the inner contact rod 44 (which may be the same as the radial spacing R3 between the axis of the axial end 38*a* of the middle contact rod 38 and the axis of the axial end 40*a* of the outer contact rod 40).

The middle contact rod 38 is arranged above and spaced from a second side 22*b* of the sheet of material 22, such that the axial end 38*a* of the middle contact rod 38 does not contact the sheet of material 22. In an exemplary application, the sheet of material 22 is a wire mesh having longitudinal features 64 that correspond to continuous longitudinal wires of the metal mesh material, and the spacing R1 may be an exact multiple of the spacing between adjacent longitudinal features 64. The inner contact rod 44 and the outer contact rod 40 are positioned such that a point of contact 66 between the sheet of material 22 and the corresponding contact rod 40, 44 is between adjacent longitudinal wires 64. The contact rods 40, 44 are thus positioned such that the point of contact 66 will always be between two longitudinal wire 64 along the length of the frame 36. Advantageously, shifting or twisting of the wire mesh is prevented by the arrangement of the contact rods 40, 44.

FIG. 6 shows a downstream front sectional view of the contact rods 38, 40, 44 and the sheet of material 22 as cut along line B-B shown in FIG. 4. The axis of the middle contact rod 38 is displaced relative to the position of the axis in FIG. 5 such that the middle contact rod 38 is in engagement with the second side 22*b* of the sheet of material 22 opposite the first side 22*a*. Accordingly, the radial spacing R2 between the middle contact rod 38 and the inner contact rod 44, and the radial spacing R3 between the middle contact rod 38 and the outer contact rod 40 are decreased relative to the radial spacings R2, R3 shown in FIG. 5. The axis of the outer contact rod 40 is displaced upwardly relative to the inner contact rod 44 and inwardly toward the middle contact rod 38, such that the sheet of material 22 is bent around the middle contact rod 38 to start forming the bend portion 32 of the sheet of material 22.

As shown in FIGS. 5 and 6, the contact rods 38, 40, 44 are also positioned to maintain a constant length of a curve of the sheet of material 22 formed by the intersection of the sheet of material 22 with any plane that is perpendicular to the longitudinal axis A (shown in FIG. 1). The curve is defined between an inner contact point between the inner contact rod 44 and the first side 22*a* of the sheet of material 22 and an outer contact point 66 between the outer contact rod 40 and the first side 22*a* of the sheet of material 22. Accordingly, at any given cross-section perpendicular to the longitudinal axis A where both the inner contact rod 44 and the outer contact rod 40 contact the sheet of material 22, the distance measured along the curve of the profile of the sheet of material 22 will be the same. The total curve length may be defined as a sum of three curves including a linear length between the middle contact rod 38 and the outer contact rod 40, a linear length between the middle contact rod 38 and the inner contact rod 44, and the arc which connects the linear lengths and wraps around the middle contact rod 38, such that the arc has a same radius as the middle contact rod 38.

FIG. 7 shows still a farther downstream front sectional view of the contact rods 38, 40, 44 and the sheet of material 22 as cut along line C-C shown in FIG. 4. As compared with the position shown in FIG. 6, the axis of the outer contact rod 40 is displaced upwardly and toward the middle contact rod 38 to further bend the bend portion 32 of the sheet of material 22 about the middle contact rod 38. In an exemplary embodiment, the shape of the outer contact rod 40 may curve in a counter-clockwise direction about the middle contact rod 38. In other exemplary embodiment, the curvature may occur in a clockwise direction. The radial spacing R2 between the middle contact rod 38 and the inner contact rod 44 may remain the same as the radial spacing R2 of FIG. 6 and the radial spacing R3 between the middle contact rod 38 and the outer contact rod 40 may further decrease as compared with the radial spacing R3 of FIG. 6.

FIG. 8 shows a farther downstream front sectional view of the contact rods 38, 40, 44 and the sheet of material 22 as cut along line D-D shown in FIG. 4. FIG. 8 shows a final bending stage in which the sheet of material 22 is formed into a final bend profile. As shown in FIG. 8, the outer contact rod 40 is displaced to move closer to the middle contact rod 38 and the bend portion 32 is bent by approximately 90 degrees relative to the sheet of material 22. Other bend angles that are greater or less than 90 degrees may be suitable as required for a particular application.

As shown by comparing FIGS. 5-8, the trajectory of the point of contact 66 shown in FIG. 5 forms an involute curve about the middle contact rod 38 when projected onto a plane that is perpendicular to the downstream direction 26 and the longitudinal axis A of the frame 36 (shown in FIG. 1). The trajectory enables the distance from the outer edge 50 of the sheet of material 22 to the point of contact 66 with the outer contact rod 40 to remain constant as the sheet of material 22 is wrapped around the middle contact rod 38. Due to the constant distance, the longitudinal wires 64 of the sheet of material 22 are prevented from passing over or rubbing against the inner contact rod 44 and the outer contact rod 40 thereby reducing friction and skewing forces.

FIG. 9 shows a farther downstream front sectional view of the contact rods 38, 40, 44 and the formed sheet of material 30 as cut along line E-E shown in FIG. 4. The outer contact rod 40 may be formed to slightly retract away from the middle contact rod 38 after the sheet of material 22 has been formed into its final profile. The retraction of the outer contact rod 40 advantageously enables the formed sheet of material 30 to spring back rather than being released abruptly at the termination of the contact rods 38, 40, 44 at the downstream end 48 of the contact rods 38, 40, 44. Furthermore, the force required to pull the formed sheet of material 30 out of the material-forming device 20 is reduced. The spring back reaction force exerted by the outer contact rod 40 on the sheet of material 22 between the position shown in FIG. 8 and the position shown in FIG. 9 may also have a slight forward component.

As shown in FIGS. 1-9, the material-forming device 20 is advantageous for continuously bending a flat strip material into a desired profile. In contrast to conventional forming processes such as roll-forming or die-forming in which strip materials may be formed in a sequence of discrete steps that cause stress concentration and kinking, the contact rods of the material-forming device 20 are configured to maintain continuous contact with the strip material through the bending process. Still other advantages of the material-forming device 20 are that the material-forming device 20 is formed of light-weight materials structural members and the material-forming device 20 is operable without electrical power or moving parts. Due to the compact configuration of the material-forming device 20, the material-forming device 20 is portable and mountable to different surfaces, such that material-forming device 20 is easily movable between job sites and may process strip material on demand. In other exemplary embodiments, the material-forming device 20 may be sized down such that the material-forming device 20 may be handheld. Accordingly, in addition to forming animal guard for solar panel installations, the material-forming device 20 may be suitable for use in other industries. The material-forming device 20 may be sized up for other specific applications. In still other embodiments, it is contemplated that feeding and removing the sheet material from the material-forming device may be automated rather than requiring manual operation.

Figure 10:
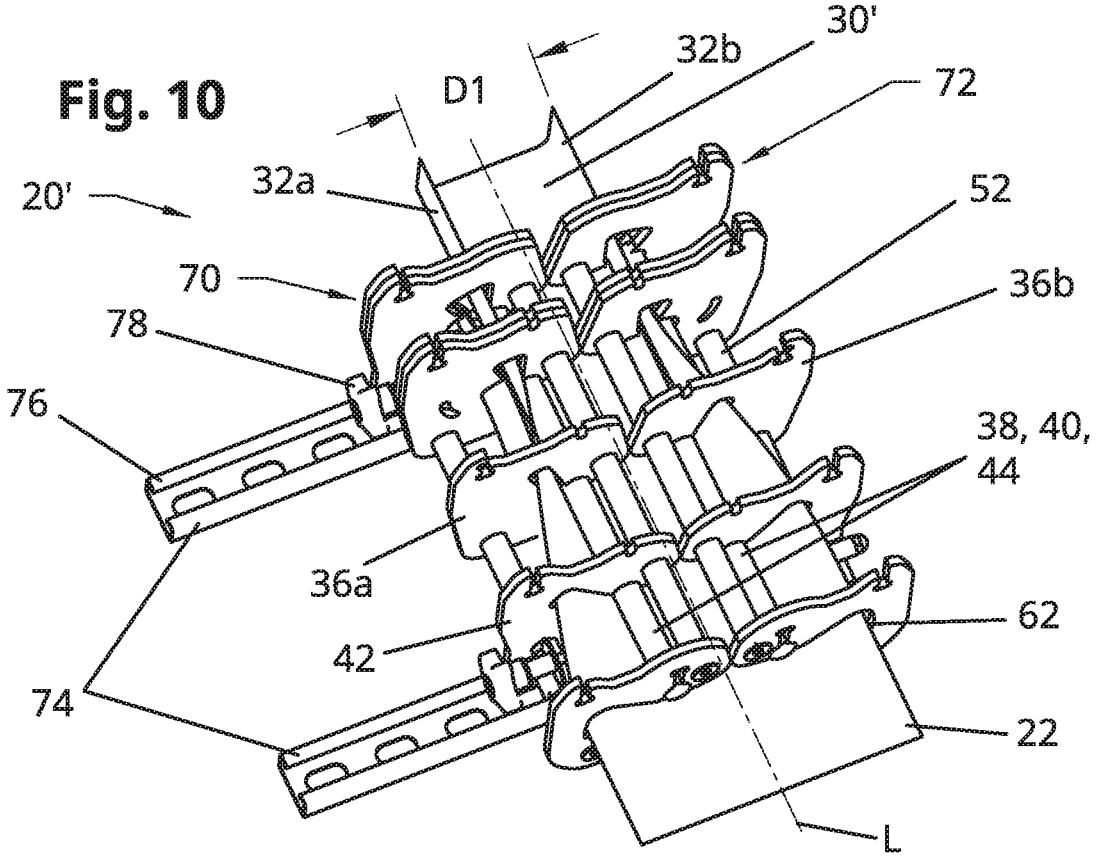
FIG. 10 shows a material-forming device according to another embodiment of the present application in which two sets of contact rods are provided.

Referring now to FIG. 10, a material-forming device 20' according to another exemplary embodiment is shown in which two forming operations are simultaneously provided by the material-forming device 20'. The material-forming device 20' includes a first side 70 and a second side 72 that each include a frame 36*a*, 36*b* that supports a corresponding plurality of contact rods 38, 40, 44. Each frame 36*a*, 36*b* has a plurality of plates 42 that are similar to the plates 42 shown in FIGS. 1 and 3. The contact rods 38, 40, 44 have an arrangement that is similar to the contact rods 38, 40, 44 shown in FIGS. 1, 2, and 4-9.

The sides 70, 72 and thus the frame 36*a*, 36*b* and contact rods 38, 40, 44 of each side 70, 72 are mirrored about the longitudinal axis L of the material-forming device 20' to form mirrored bend portions 32*a*, 32*b* in the sheet of material 22. The material-receiving through-slots 62 of the frames 36*a*, 36*b* are open toward and face each other. As the sheet of material 22 is pulled through the material-forming device 20', the sheet of material 22 is simultaneously acted on by both sets of contact rods 38, 40, 44. In other exemplary embodiments, two forming operations may be provided sequentially rather than simultaneously. For example, two or more sets of contact rods 38, 40, 44 may be axially adjacent in the downstream direction. The material-forming device 20' may thus be modular in that any number of sets of contact rods 38, 40, 44 may be configured to simultaneously and/or sequentially form different bend profiles for a sheet of material.

The bend portions 32*a*, 32*b* may be angled by approximately 90 degrees relative to the planar portion and are symmetrical about the longitudinal axis L, such that the formed sheet of material 30' has a U-shape. Other angles that are smaller or greater than 90 degrees may also be suitable. The bend portions 32*a*, 32*b* may have the same angle or different angles, depending on the arrangement of the contact rods 38, 40, 44 corresponding to a particular side 70, 72. Similarly, sequentially arranged sets of contact rods 38, 40, 44 may be arranged differently to provide different bend angles.

Figure 11:
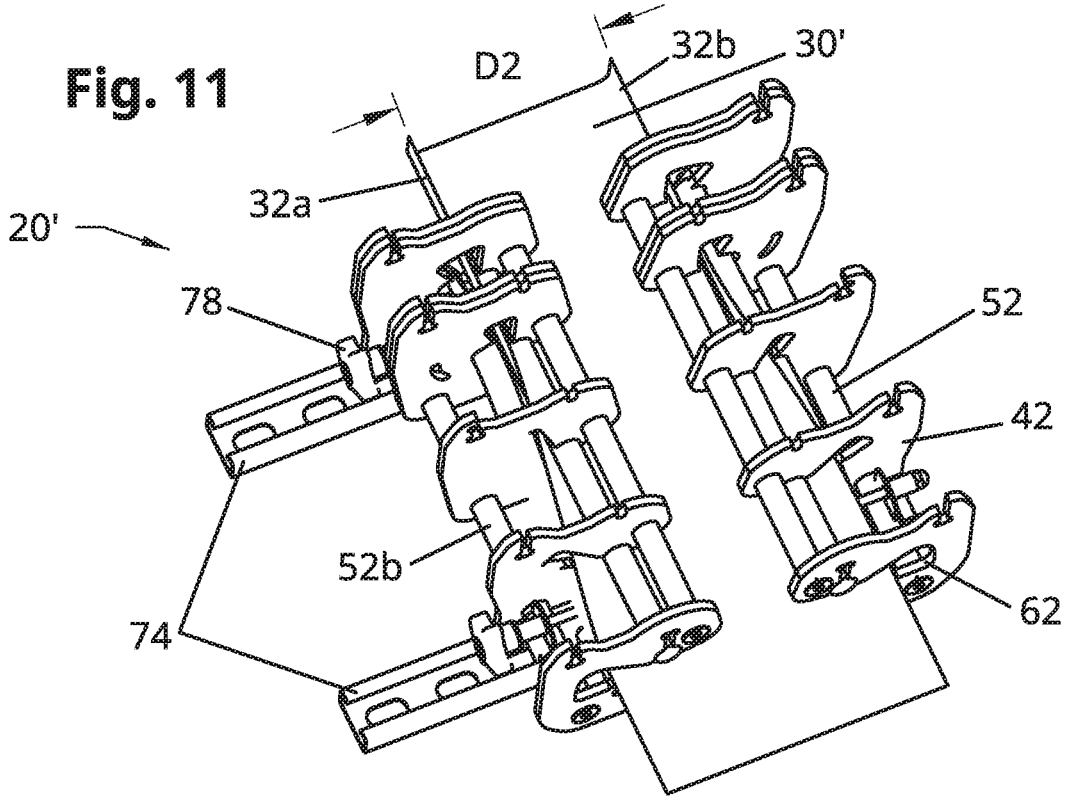
FIG. 11 shows the material-forming device of FIG. 10 with an adjusted spacing between the two sets of contact rods.

Referring in addition to FIG. 11, each frame 36*a*, 36*b* may be independently mounted to a support structure 74 such that the distance between the sets of contact rods 38, 40, 44 may be adjusted. An adjustable connection between the frame 36*a*, 36*b* and the support structure 74 is provided to enable positioning the frames 36*a*, 36*b* relative to each other. The frames 36*a*, 36*b* may be slidable over the support structure 74 which may be mounted to a main supporting structure and is formed of at least one track 76. The material-forming device 20' may be configured to self-center or self-align relative to the at least one track 76 by way of alignment of the contact rods 38, 40, 44 and the longitudinal features of the wire mesh. Accordingly, shifting of the wire mesh is prevented.

The at least one track 76 may include parallel tracks 76 that extend in a direction that is transverse or perpendicular to the longitudinal axis L of the material-forming device 20'. Two or more tracks 76 may be provided. The tracks 76 may be arranged at opposite ends of the frames 36*a*, 36*b* and each track 76 may extend between two adjacent plates 42. The rigid tubes 52 and contact rods 38, 40, 44 are positioned at a height that is high enough to enable the rigid tubes 52 and contact rods 38, 40, 44 to slide over the parallel tracks 76 in a radial direction relative to the longitudinal axis L of the material-forming device 20'.

The adjustable connection between the frame 36 and the tracks 76 may be formed using any suitable securing device. Each track 76 may have a corresponding securing device. For example, a clamp having an adjustment knob 78 may be provided and the clamp may be clamped between one of the tracks 76 and a rigid tube 52*b*, at an axial position between two adjacent plates 42. The adjustment knob 78 may have a threaded engagement with the clamp. Other locking mechanisms, such as pins, screws, bolts, sockets, springs, other fasteners, etc. may be provided to enable locking and unlocking a position of the frames 36*a*, 36*b*. In still other exemplary embodiments, the clamp or other fastener may be secured between the track 76 and another structural member of the frame 36, such as one of the plates 42.

The frames 36*a*, 36*b* may be movable toward and away from each other along the parallel tracks 76 to adjust a distance D1, D2 between the bend portions 32*a*, 32*b*. As shown in FIG. 10, the frames 36*a*, 36*b* are positioned proximate each other and the longitudinal axis L to form the distance D1. As shown in FIG. 11, the frames 36*a*, 36*b* are spaced from each other to form the distance D2 that is greater than D1. Using the adjustment connection and the independently mounted frames 36*a*, 36*b* is advantageous in enabling the material-forming device 20' to accommodate different sizes of the sheet of material 22.

Figure 12:
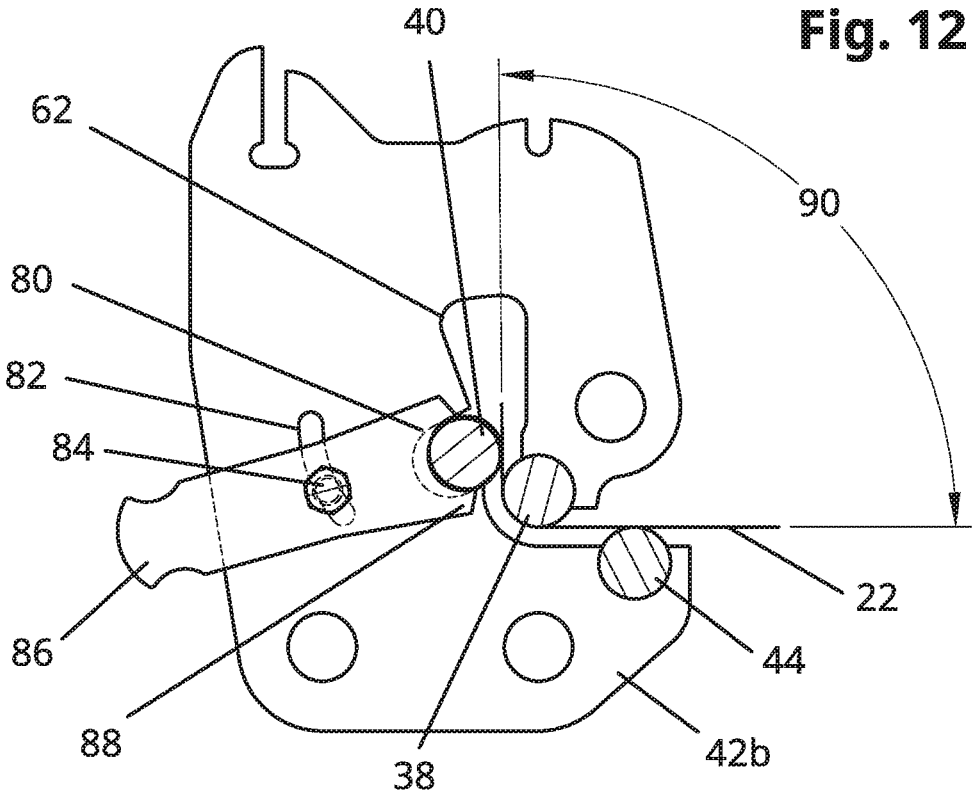
FIG. 12 shows a material-forming device according to still another embodiment of the present application in which a bend angle of the sheet of wire mesh is adjustable via an adjustment arm of the material-forming device.
Figure 13:
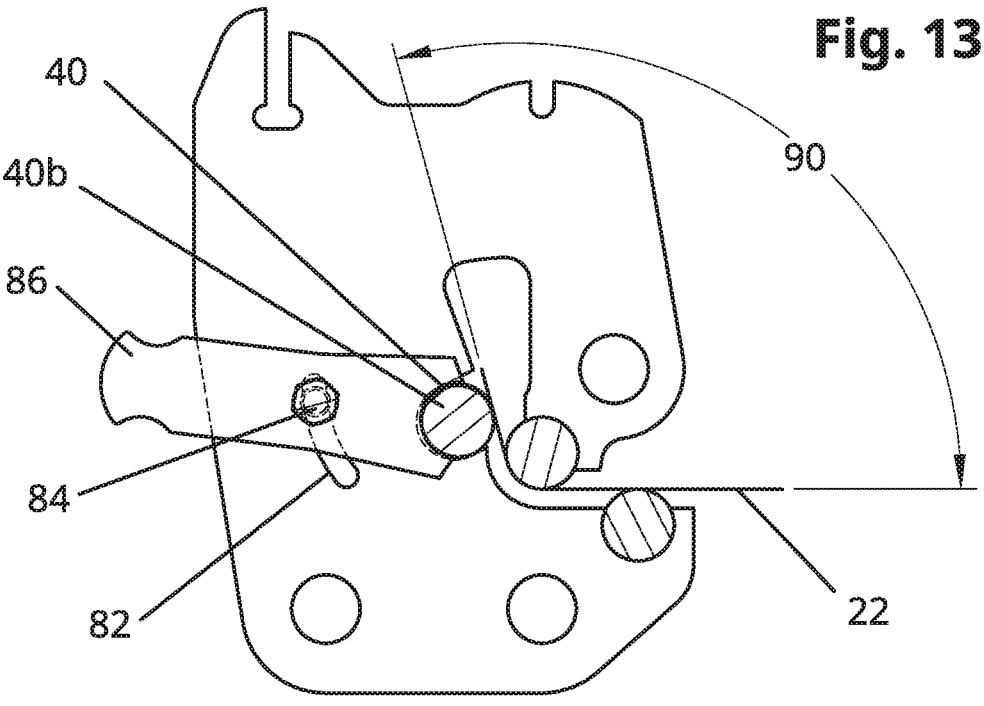
FIG. 13 shows the material-forming device of FIG. 12 in which an axial end of the outer contact rod is displaced by the adjustment arm.

Referring now to FIGS. 12 and 13, another exemplary embodiment of the material-forming device 20, 20' is shown in which the angle of the bend formed in the sheet of material 22 is adjustable, as an alternative to the non-adjustable spring back stage shown in FIG. 9. The plate 42 is configured to hold the contact rods 38, 40, 44 in position, which is similar to the final bending stage position shown in FIG. 8. The outer contact rod 40 may be formed of a flexible material which is bendable to achieve a different final bend profile of the sheet of material 22 by adjusting the position of an axial end of the outer rod 42 at the final bending stage. The plate 42 may be a downstream axial plate 42 and the plate 42 has a first radial slot 80 and a second radial slot 82 formed therein. The radial slots 80, 82 are spaced relative to each other.

The first radial slot 80 intersects the material-receiving through-slot 62 and is configured to accommodate the outer contact rod 40. A perimeter of the first radial slot 80 may correspond to the diameter of the outer contact rod 40 and may be slightly larger than the diameter of the outer contact rod 40. The second radial slot 82 may be crescent-shaped and is configured to receive a longitudinally-extending pin or bolt 84 of an adjustment arm 86. The adjustment arm 86 is thus mounted to the plate 42*b* via the engagement between the bolt 84 and the second radial slot 82. The outer contact rod 40 is configured to be radially adjusted or bent by engaging claws 88 of the adjustment arm 86 that engage around the outer diameter of the outer contact rod 40. The bolt 84 is movable along the length of the second radial slot 82 to move the adjustment arm 86 upwardly and downwardly and adjust a bend angle 90 of the sheet of material 22.

As shown in FIG. 13, the adjustment arm 86 is displaced upwardly via the bolt 84 being moved to an end of the second radial slot 82. The axial end 40*b* of the outer contact rod 40 is slightly displaced relative to the position shown in FIG. 12, such that the bend angle 90 is greater than the bend angle 90 shown in FIG. 12. For example, the bend angle 90 in FIG. 12 may be approximately 90 degrees, whereas the bend angle 90 in FIG. 13 may be an angle that is between 105 and 115 degrees.

Figure 14:
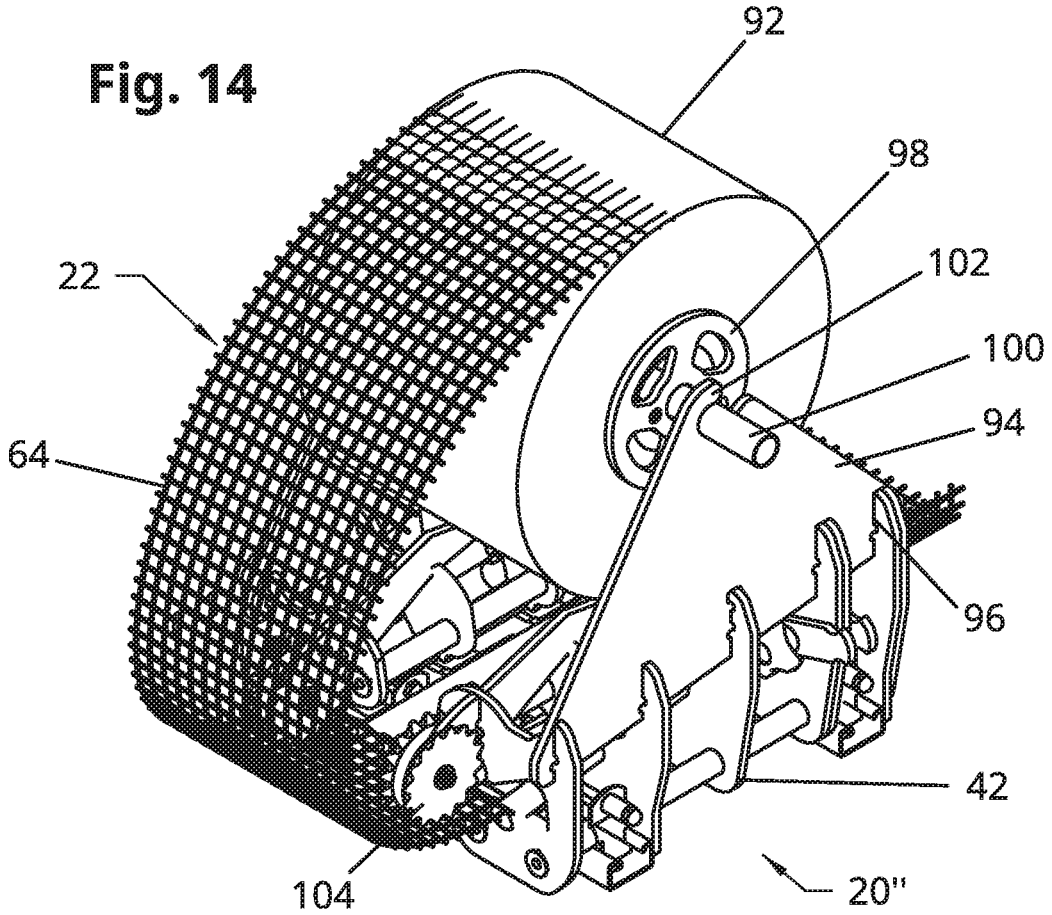
FIG. 14 shows a material-forming device according to still another embodiment of the present application in which the material-forming device is configured to hold a roll of material.
Figure 15:
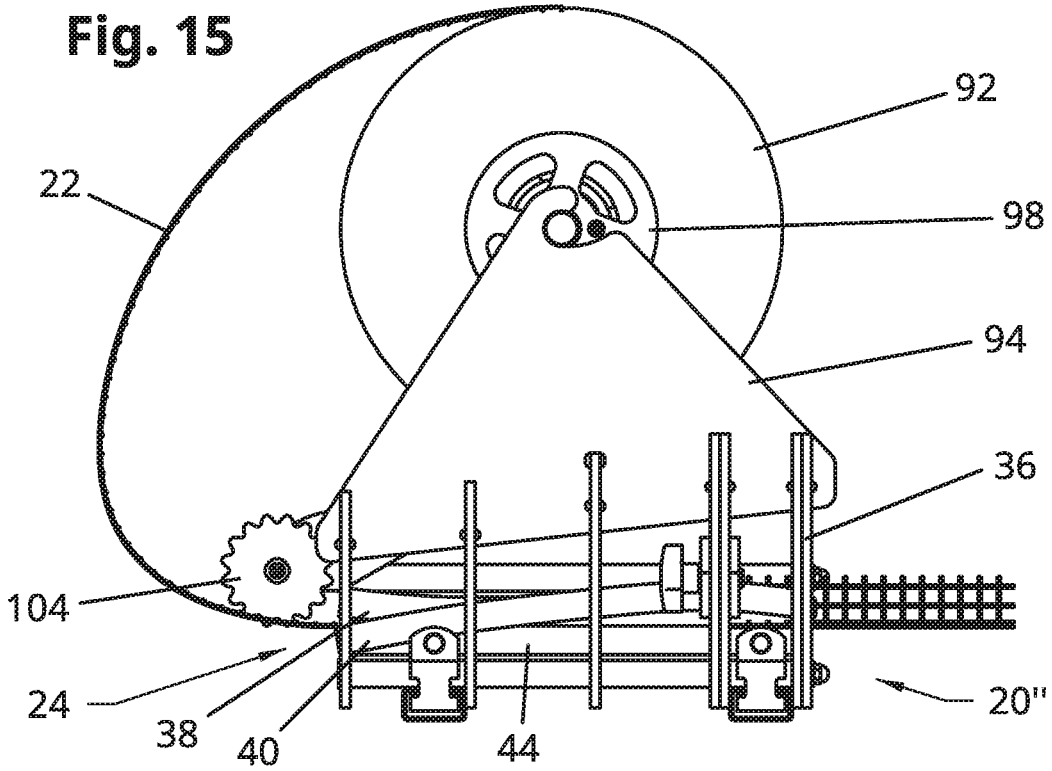
FIG. 15 shows a side view of the material-forming device of FIG. 14.

Referring now to FIGS. 14 and 15, still another exemplary embodiment of the material-forming device 20" is shown in which the material-forming device 20" is configured to support a roll 92 of the sheet of material 22, which may be a sheet metal or wire mesh having longitudinal wires 64. The roll 92 of the sheet material 22 is mounted to a stock support 94 and is configured to rotate, such that the sheet of material 22 is fed directly into the material-forming device 20". Advantageously, the material-forming device 20" enables easy storage and transport of the raw material with the material-forming device 20".

Each of the plates 42 has a stock support-receiving aperture 96 that extends upwardly or normal relative to the axial direction in which the plates 42 are arranged. Each stock support-receiving aperture 96 is configured to receive the stock support 94 and holds the stock support 94 in a position in which the stock support 94 extends upwardly relative to the axial direction. The stock support 94 may have any suitable shape, such as rectangular or triangular. Spindle adapters 98 are mounted to a spindle 100 that is engageable by a hook portion 102 of the stock support 94. The hook portion 102 radially curves around the spindle 100. Two or more spindle adapters 98 may be provided and the spindle adapters 98 are configured to fit inside the roll 92 of the sheet of material 22. The spindle adapters 98 are configured to provide a bushing interface between the roll 92 and the spindle 100 thereby decreasing the force required to pull the sheet of material 22 through the material-forming device 20".

Figure 16:
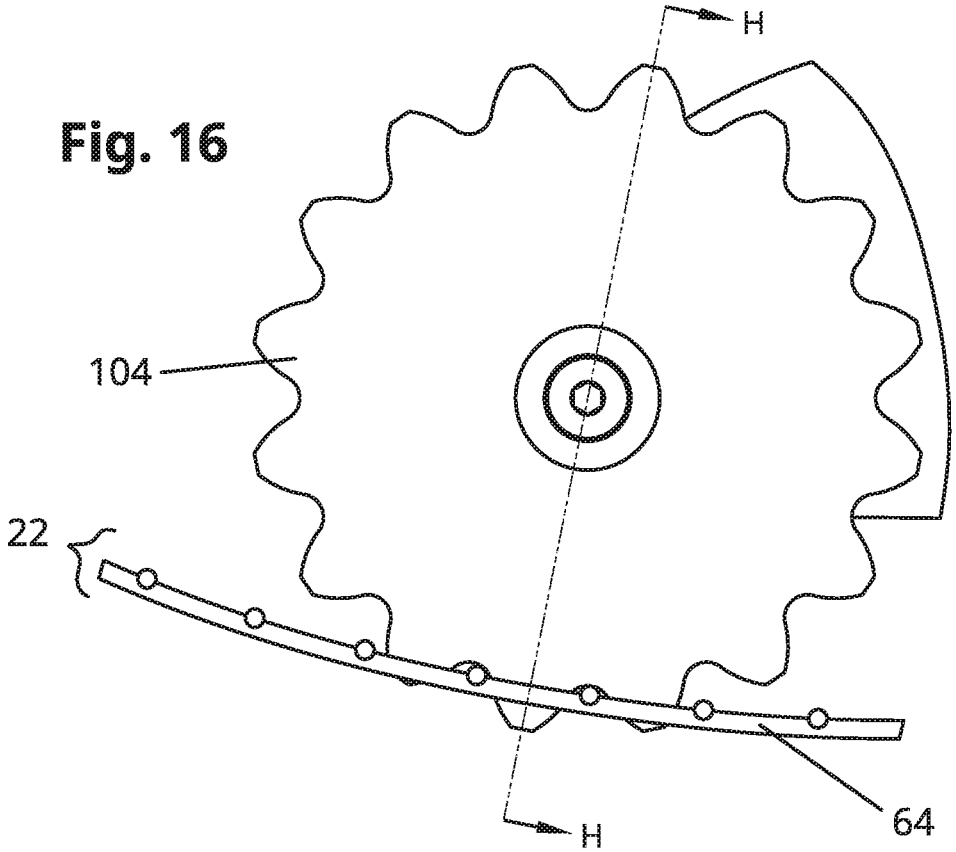
FIG. 16 shows a side view of a sprocket that engages the sheet of wire mesh in the material-forming device of FIG. 14.
Figure 17:
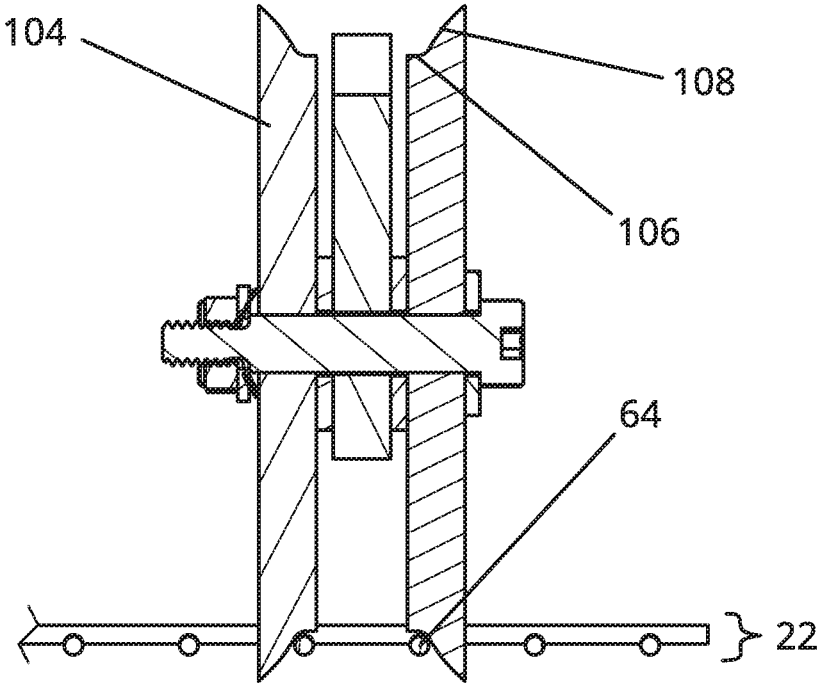
FIG. 17 shows a front cross-sectional view of the sprocket of FIG. 16 taken along line H-H.

Referring in addition to FIGS. 16 and 17, sprockets 104 may be provided to guide the sheet of material 22 into the entry end 24 of the material-forming device 20". The sprockets 104 may be arranged on opposing sides of the frame 36 and are configured to provide a low-friction guide that aligns the sheet of material 22 vertically relative to the contact rods 38, 40, 44. The sprockets 104 are also arranged to constrain a horizontal position of the sheet of material 22 to prevent sideways shifting or a rotation that is out of alignment with the longitudinal axis of the material-forming device 20".

FIG. 17 shows a cross-sectional view of the sprocket 104 taken along line H-H of FIG. 16. As shown in FIG. 17, each sprocket 104 includes a shoulder portion 106 and a ramp portion 108. The shoulder portion 106 is configured to receive longitudinal wires 64 such that the longitudinal wires 64 rest against the shoulder portion 106. The ramp portion 108 is adjacent the shoulder portion 106 and is configured to prevent the longitudinal wire 64 from moving out of place. For example, if the longitudinal wire 64 is shifted or twisted, the longitudinal wire 64 will engage the ramp portion 108 which will push the longitudinal wire 64 back against the shoulder portion 106.

Figure 18:
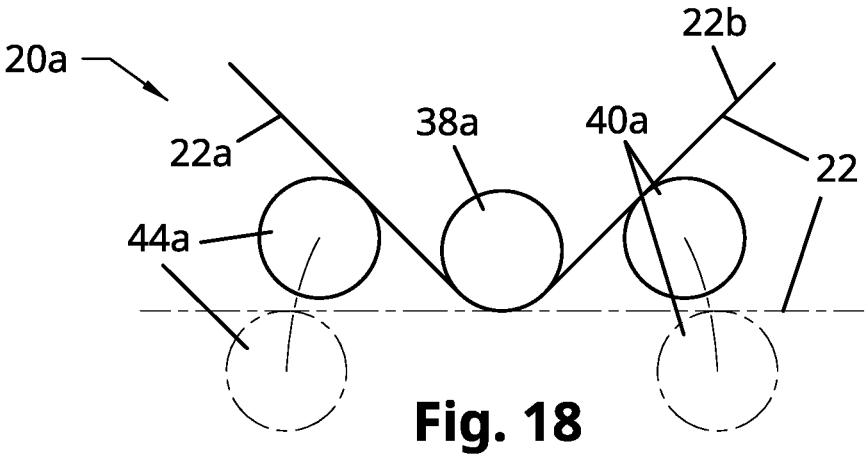
FIG. 18 shows an arrangement of the contact rods according to another exemplary embodiment of the present application in which both the inner contact rod and the outer contact rod have a non-linear axis.
Figure 19:
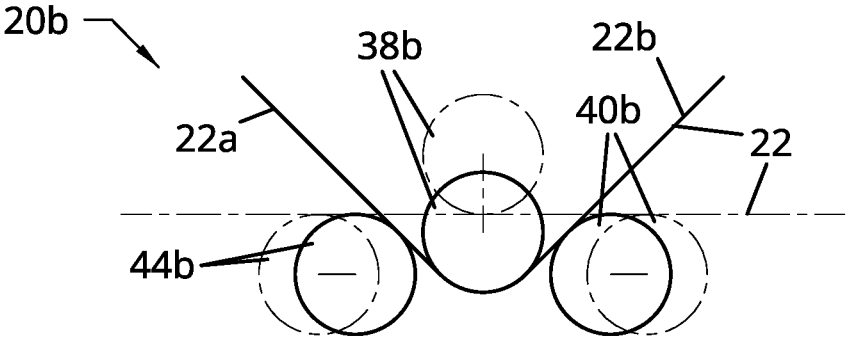
FIG. 19 shows an arrangement of the contact rods according to still another exemplary embodiment of the present application in which the middle contact rod has a non-linear axis.
Figure 20:
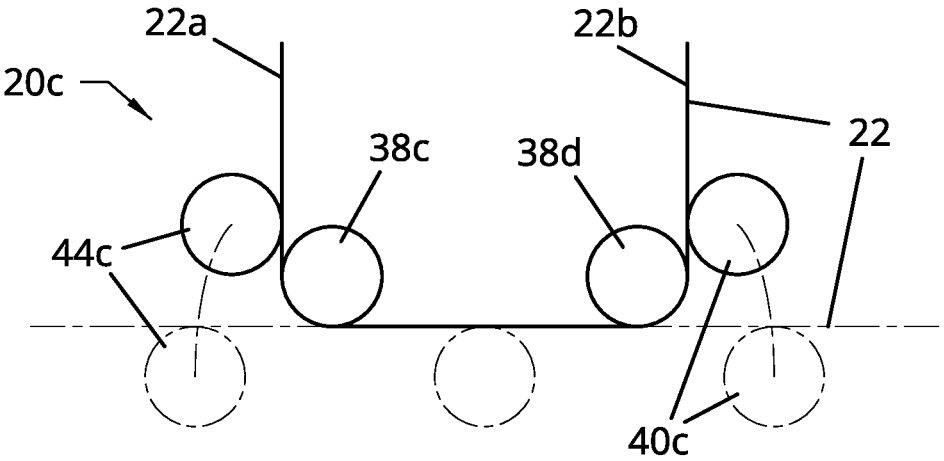
FIG. 20 shows an arrangement of the contact rods according to still another exemplary embodiment of the present application in which two middle contact rods engage the sheet of wire mesh.

Referring now to FIGS. 18-20, material-forming devices 20*a*, 20*b*, 20*c* having other arrangements of the contact rods may be suitable to achieve different bend profiles of the sheet of material 22. FIG. 18 shows the material-forming device 20*a* having the outer contact rod 40*a* and the inner contact rod 44*a* that engage the first side 22*a* of the sheet of material 22, and the middle contact rod 38*a* that engages the second side 22*b* of the sheet of material 22. The middle contact rod 38*a* may have a linear axis that is parallel with the longitudinal axis A (shown in FIG. 1). In other exemplary embodiments, the middle contact rod 38*a* may have a non-linear axis or a linear axis that is non-parallel with the longitudinal axis A.

Each of the outer contact rod 40*a* and the inner contact rod 44*a* may have a non-linear axis and serpentine shape as represented by comparing a position of the inner contact rod 44*a* and the outer contact rod 40*a* at an upstream end of the contact rods 40*a*, 44*a*, as shown in phantom lines, with a position of the inner contact rod 44*a* and the outer contact rod 40*a* at a downstream end of the contact rods 40*a*, 44*a*, as shown in solid lines. For example, the shape of the outer contact rod 40*a* and the inner contact rod 44*a* may be similar to the shape of the outer contact rod 40 shown in FIGS. 2 and 4. Other serpentine and non-linear shapes may be suitable. In an exemplary embodiment, the shapes of the outer contact rod 40*a* and the inner contact rod 44*a* may be symmetrical about the middle contact rod 38*a*. In other exemplary embodiments, the shapes of the outer contact rod 40*a* and the inner contact rod 44*a* may be different.

FIG. 19 shows the material-forming device 20*b* having the middle contact rod 38*b* that engages the second side 22*b* of the sheet of material 22, and the outer contact rod 40*b* and the inner contact rod 44*b* that engage the first side 22*a* of the sheet of material 22. The material-forming device 20*b* may be configured to provide a similar bend profile of the sheet of material 22 as the material-forming device 20*a* shown in FIG. 18. In contrast to the material-forming device 20*a*, the middle contact rod 38*b* may have an axis that is non-linear as shown by comparing a position of the middle contact rod 38*b* at an upstream end of the middle contact rod 38*b*, as shown in phantom lines, with a position of the middle contact rod 38*b* at a downstream end of the middle contact rod 38*b*, as shown in solid lines. The outer contact rod 40*b* and the inner contact rod 44*b* may have an axis that is either non-linear or linear and non-parallel relative to the longitudinal axis A (shown in FIG. 1).

FIG. 20 shows two middle contact rods 38*c*, 38*d* that are radially spaced and engage the second side 22*b* of the sheet of material 22, and the outer contact rod 40*c* and the inner contact rod 44*c* that engage the first side 22*a* of the sheet of material 22. The arrangement of the middle contact rods 38*c*, 38*d* may be advantageous in forming two bends in the sheet of material 22, such as between a first middle contact rod 38*c* and the inner contact rod 44*c*, and between a second middle contact rod 38*d* and the outer contact rod 40*c*. The middle contact rods 38*c*, 38*d* each may have linear axes that are parallel to each other and parallel to the longitudinal axis A. The inner contact rod 44*c* and the outer contact rod 40*c* may have non-linear axes, as shown in FIG. 20.

In other exemplary embodiments, the axes of the middle contact rods 38*c*, 38*d* may be linear and non-parallel to the longitudinal axis A, or non-linear, with the axes of the inner contact rod 44*c* and the outer contact rod 40*c* being linear. For example, the middle contact rods 38*c*, 38*d* may have serpentine shapes that are symmetrical relative to a center of the contact rod arrangement. Many other contact rod arrangements are suitable. In other exemplary embodiments, all of the axes of the contact rods may be linear and at least one of the axes may be non-parallel relative to the longitudinal axis A.

Although three contact rods may be required to form a single bend in the sheet of material, four or more contact rods may be used to form two or more bends in the sheet of material. The contact rod arrangement may include any combination of contact rods having linear axes that are parallel or non-parallel with the longitudinal axis A, and/or contact rods having non-linear axes and serpentine shapes. In all of the embodiments, a total curve length between any two contact rods touching any side of the sheet of material 22 from which longitudinal features protrude (such as the longitudinal wires 64 shown in FIG. 5) may be held constant at a length that is a multiple of the spacing between adjacent longitudinal features.

Figure 21:
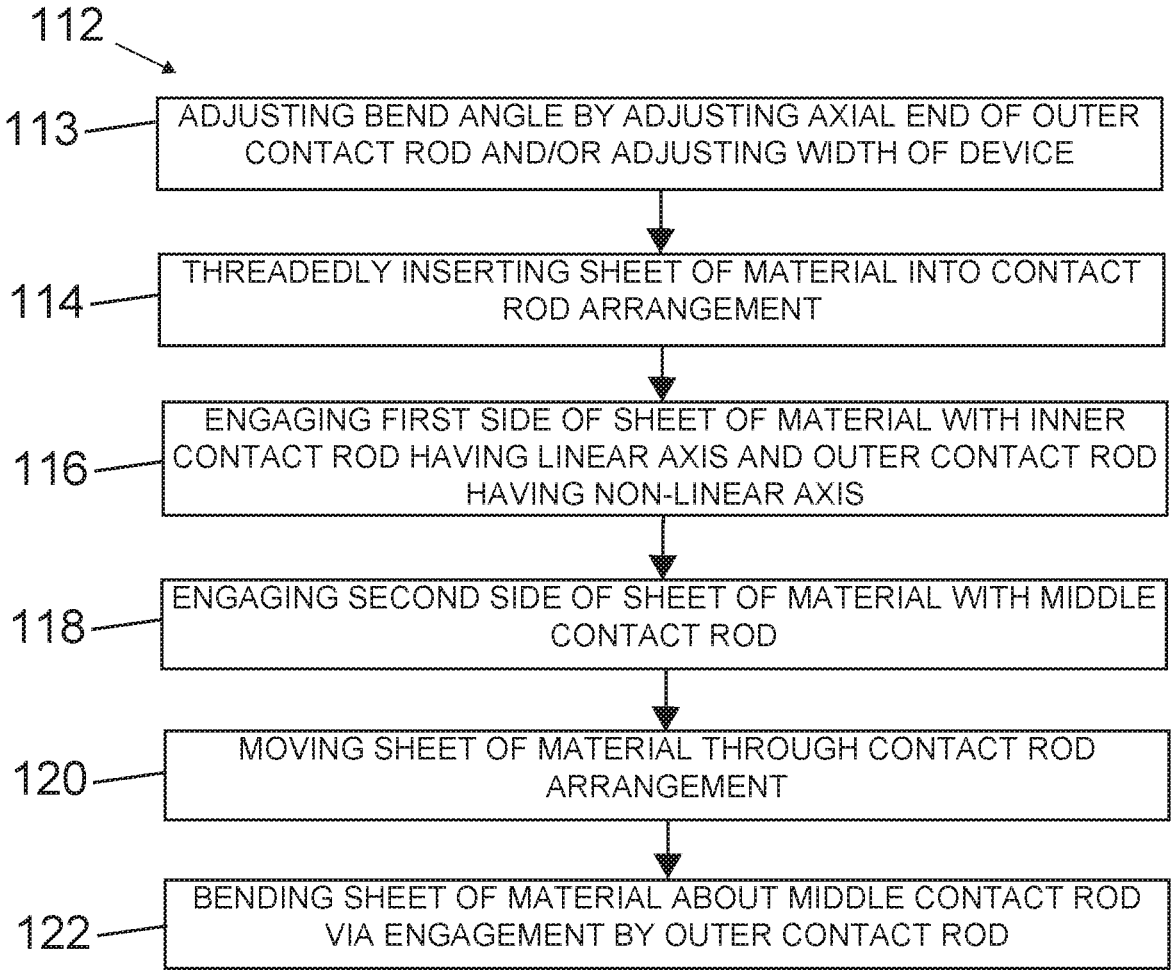
FIG. 21 shows a flowchart for a method of bending a sheet of wire mesh which may be performed using the material-forming device of FIGS. 1-20.

Referring now to FIG. 21, a method 112 of bending a sheet of material, such as the sheet of material 22 shown in FIG. 1, is shown. The method 112 may be performed using the material-forming device 20, 20', 20", 20*a*, 20*b*, 20*c* as shown in FIGS. 1-20. Step 113 of the method 112 includes adjusting the bend angle of the sheet of material 22 by bending an axial end 40*b* of the outer contact rod 40 (shown in FIGS. 12 and 13). Step 113 may include adjusting the width of the material-forming device 20' (shown in FIGS. 10 and 11). After the material-forming device 20, 20', 20" is adjusted, step 114 of the method 112 includes threadedly inserting a sheet of material 22 into a contact rod arrangement 38, 40, 44 supported by a frame 36 (shown in FIGS. 1-3).

Step 116 of the method 112 includes engaging a first side 22*a* of the sheet of material 22 with an inner contact rod 44 having a linear axis and an outer contact rod 40 that has a non-linear axis (shown in FIG. 5). The non-linear axis of the outer contact rod 40 is formed such that a trajectory of the point of contact 66 between the outer contact rod 40 and the sheet of material 22 defines an involute curve about the middle contact rod 38 in a plane that is perpendicular to the downstream direction 26. Step 118 of the method 112 includes engaging a second side 22*b* of the sheet of material 22 that opposes the first side 22*a* with a middle contact rod 38 that is radially spaced from and positioned between the inner contact rod 44 and the outer contact rod 40 (shown in FIG. 6).

Step 120 of the method 112 includes moving the sheet of material 22 through the contact rod arrangement 38, 40, 44 in a downstream direction 26 (shown in FIG. 1.) The contact rod arrangement 38, 40, 44 are elongated in the downstream direction and the sheet of material 22 moves through the contact rod arrangement 38, 40, 44. Step 122 of the method 112 includes bending the sheet of material 22 about the middle contact rod 38 via engagement by the outer contact rod 40 against the sheet of material 22 as the sheet of material 22 is moved in the downstream direction (shown in FIGS. 6-8).

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A material-forming device for a wire mesh having longitudinally extending wires and laterally extending wires overlapping the longitudinally extending wires, the material-forming device comprising:

a frame defining a longitudinal axis along which the wire mesh is feedable with the longitudinally extending wires oriented in the direction of the longitudinal axis of the device; and a plurality of contact rods that are supported by the frame and elongated along the longitudinal axis, the plurality of contact rods being configured to threadedly receive a sheet of the wire mesh that moves through the plurality of contact rods in a downstream direction that is parallel to the longitudinal axis, the plurality of contact rods including an inner contact rod and an outer contact rod that are each configured to engage a first side of the sheet of wire mesh, and a middle contact rod positioned between the inner contact rod and the outer rod and configured to engage a second side of the sheet of wire mesh that opposes the first side, wherein at least one of the outer contact rod and the inner contact rod is configured to bend the sheet of wire mesh about the middle contact rod as the sheet of wire mesh moves in the downstream direction;

wherein the plurality of contact rods are positioned such that a trajectory of a point of contact between at least one of the outer contact rod and the sheet of wire mesh or the inner contact rod and the sheet of wire mesh defines an involute curve about the middle contact rod when projected onto a plane that is perpendicular to the longitudinal axis, and wherein the involute curve is defined such that the point of contact always contacts the sheet of wire mesh between a pair of the longitudinal wires to thereby restrict lateral displacement of the sheet of wire mesh when being fed downstream in the device.

2. The material-forming device according to claim 1, wherein at least one of the inner contact rod and the outer contact rod is serpentine in shape.

3. The material-forming device according to claim 1, wherein the plurality of contact rods are configured to continuously contact the sheet of wire mesh during movement of the sheet of wire mesh.

4. The material-forming device according to claim 1, wherein the plurality of contact rods are radially spaced, and wherein a radial spacing between the outer contact rod and the middle contact rod changes along the longitudinal axis.

5. The material-forming device according to claim 1, wherein the plurality of contact rods are positioned to maintain a constant length of a curve formed by an intersection of the sheet of wire mesh with any plane perpendicular to the longitudinal axis, the curve of the sheet of wire mesh being defined between an inner contact point between the inner contact rod and the first side of the sheet of wire mesh and an outer contact point between the outer contact rod and the first side of the sheet of wire mesh.

6. The material-forming device according to claim 1, wherein the outer contact rod is formed of a flexible material.

7. The material-forming device according to claim 1, wherein the middle contact rod has a linear axis that is parallel with the longitudinal axis.

8. The material-forming device according to claim 7, wherein each of the inner contact rod and the outer contact rod have a non-linear axis.

9. The material-forming device according to claim 1, wherein the inner contact rod has a linear axis that is parallel with the longitudinal axis and the outer contact rod has a non-linear axis.

10. The material-forming device according to claim 1 further comprising a second inner rod that is positioned between the inner contact rod and the outer contact rod, the second inner rod being radially spaced from the inner rod and configured to engage the second side of the sheet of wire mesh.

11. The material-forming device according to claim 1, wherein the frame includes an adjustment arm engageable with a downstream axial end of the outer contact rod to displace the axial end of the outer contact rod, thereby adjusting a bend profile of the sheet of wire mesh.

12. The material-forming device according to claim 1, wherein a downstream axial end of the outer contact rod is retractable in a radial direction away from the middle contact rod.

13. The material-forming device according to claim 1, wherein the plurality of contact rods includes two or more sets of contact rods, each of the sets of contact rods having the inner contact rod, the outer contact rod, and the middle contact rod, the two or more sets of contact rods being configured to simultaneously or sequentially engage the sheet of wire mesh.

14. The material-forming device according to claim 13, wherein the frame includes separable frame portions that each support one of the sets of contact rods and are movable toward and away from each other to adjust a distance between the sets of contact rods.

15. The material-forming device according to claim 1, wherein the frame includes at least one plate that supports the plurality of contact rods, and wherein the at least one plate defines a material-receiving through-slot through which the sheet of wire mesh passes without contacting the at least one plate.

16. The material-forming device according to claim 15, wherein the at least one plate includes a plurality of plates that are parallel and axially spaced, each of the plurality of plates having a cutout that intersects the material-receiving through-slot and supports the plurality of contact rods.

17. A method of bending a sheet of wire mesh having longitudinally extending wires and laterally extending wires overlapping the longitudinally extending wires, the method comprising:

threadedly inserting the sheet of wire mesh into a contact rod arrangement supported by a frame defining a longitudinal axis, such that the longitudinally extending wires of the sheet of wire mesh are oriented in the direction of the longitudinal axis of the frame;

engaging a first side of the sheet of wire mesh with an inner contact rod and an outer contact rod that is radially spaced from the inner contact rod;

engaging a second side of the sheet of wire mesh that opposes the first side with a middle contact rod that is radially spaced from and positioned between the inner contact rod and the outer contact rod;

moving the sheet of wire mesh through the contact rod arrangement in a downstream direction that is parallel to the longitudinal axis; and bending the sheet of wire mesh about the middle contact rod via at least one of the inner contact rod and the outer contact rod engaging the sheet of wire mesh as the sheet of wire mesh is moved in the downstream direction;

wherein the plurality of contact rods are positioned such that a trajectory of a point of contact between at least one of the outer contact rod and the sheet of wire mesh or the inner contact rod and the sheet of wire mesh defines an involute curve about the middle contact rod when projected onto a plane that is perpendicular to the longitudinal axis, and wherein the involute curve is defined such that the point of contact always contacts the sheet of wire mesh between a pair of the longitudinal wires to thereby restrict lateral displacement of the sheet of wire mesh when being fed downstream in the device.

18. The method according to claim 17 further comprising at least one of:

adjusting a bend angle of the sheet of wire mesh by bending an axial end of the outer contact rod; and adjusting a width of the contact rod engagement.

* * * * *